United States Patent [19]

Pace

[11] Patent Number: 4,963,175

[45] Date of Patent: Oct. 16, 1990

[54] KEG COOLER TUB

[76] Inventor: Donald E. Pace, 746 Peine, Wentzville, Mo. 63385

[21] Appl. No.: 419,547

[22] Filed: Oct. 10, 1989

[51] Int. Cl.[5] ..... F25D 3/08

[52] U.S. Cl. ..... 62/372; 62/400; 62/464; 62/457.1

[58] Field of Search ..... 62/400, 372, 457.1, 62/464

[56] References Cited

U.S. PATENT DOCUMENTS

| | | | |
|---|---|---|---|
| 3,443,397 | 5/1969 | Donovan et al. | 62/400 |
| 3,614,875 | 10/1971 | McCallum | 62/400 |
| 4,042,142 | 8/1977 | Ruano | 62/400 X |
| 4,653,290 | 3/1987 | Byrne | 62/400 |
| 4,802,344 | 2/1989 | Livingston | 62/400 |
| 4,835,985 | 6/1989 | Ilvento | 62/400 X |

*Primary Examiner*—Lloyd L. King

*Attorney, Agent, or Firm*—Andsel Group

[57] ABSTRACT

A transportable keg cooler tub comprising a circular tub-like base with a pliable flexible canvas sleeve extending upwards from the top edge of the base. The sleeve enclosing a plastic liner in intimate contact with ice cubes filling the space between the liner and the enclosed beverage keg. A portion of the plastic liner pulled through an orifice on the bottom outside perimeter of the base providing drainage for the ice contained by the plastic liner.

1 Claim, 1 Drawing Sheet

KEG COOLER TUB

BACKGROUND OF THE INVENTION

1. Field of the Invention

The instant invention relates to thermally insulated or other beverage container keg coolers having inner and outer walls for receiving ice or other cooling material while holding the keg within the enclosure in an upright position.

2. Description of the Prior Art

Coolers for holding beverage kegs are old in the prior art. U.S. Pat. No. 4,802,344 Livingston et al, discloses a thermally insulated cooler for enclosing a beverage keg. The cooler is of a soft sided composition cylindrical in shape having a closed bottom and a removable lid. U.S. Pat. No. 3,443,397 Donovan et al, discloses a barrel cooler comprising inner and outer containers joined together and having a space between the upstanding walls for receiving a coolant. U.S. Pat. No. 3,614,875 McCallun, discloses a flexible bag having a plurality of side pockets for holding ice cubes for cooling the adjacent container. U.S. Pat. No. 4,653,290 Byrns discloses an ice sleeve cooler for beer kegs comprising a slip-over ice sleeve having inner and outer sleeve members with an ice pocket therebetween.

SUMMARY OF THE INVENTION

It is an object of the instant invention to provide a keg cooler that is transportable and that encloses the keg in a throwaway plastic, waterproof trash bag liner. A heavy duty circular tub-like plastic base with a closed bottom provides support for a flexible canvas, or similar material sleeve extending upwards from the base top with the radial space between the keg and the plastic liner for introducing ice or other coolant material. A portion of the plastic liner extending through an orifice in the bottom of the base providing drainage for the enclosed ice.

In use the throw-away trash bag is inserted in the canvas sleeve with the heavy duty base. A section of the trash bag is pulled through an orifice in the bottom of the base enclosure to be cut-off when drainage of the trash bag and the space between the trash bag and the canvas sleeve is filled with ice, or coolant. The sleeve is then pulled up to secure the top of the sleeve, the enclosed ice and the trash bag around the outer periphery of the keg by means of a draw string slidably attached to the top edge of the sleeve.

DETAILED DESCRIPTION OF THE PREFERRED EMBODIMENTS

Figure 1:
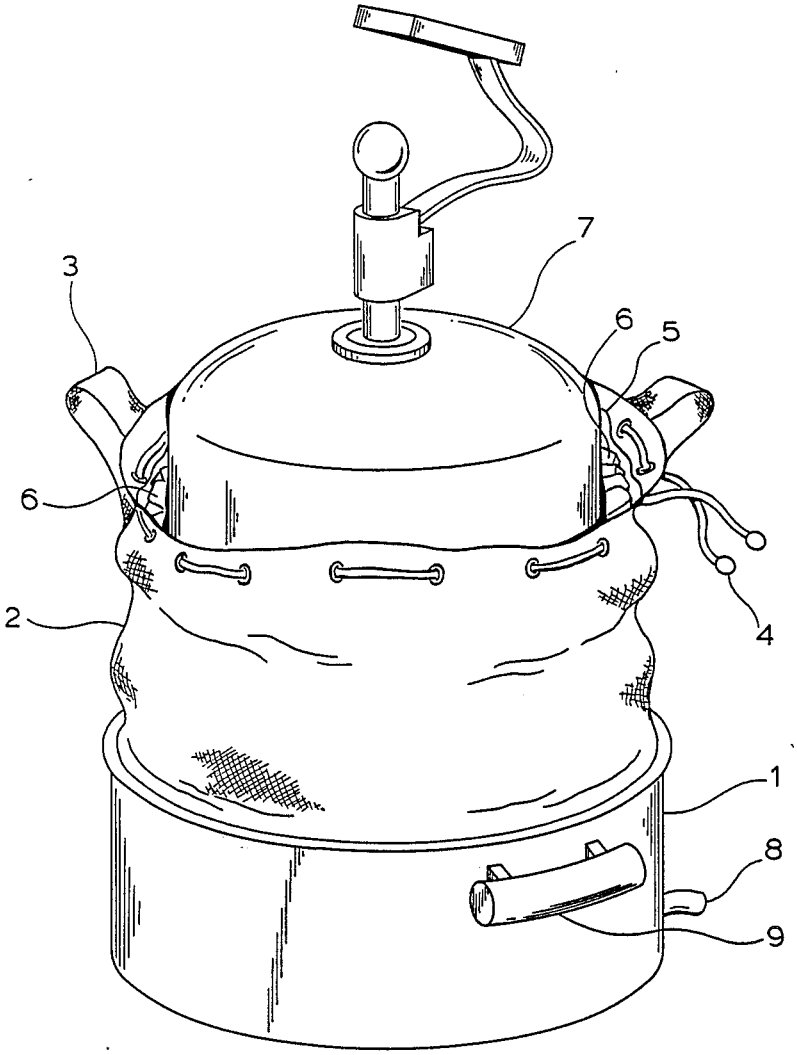
FIG. 1 is a top front perspective view of the key cooler tub.

The perspective view of FIG. 1 shows the base 1 with handle 9 and drain orifice 8. The keg 7 is inserted in trash bag 5 which is inserted in the canvas sleeve 2. The space between the trash bag 5 and the sleeve 2 is filled with ice cubes 6. The sleeve 2 with handles 3 is secured to the trash-bag and keg 7 by means of the draw string 4. A portion of the trash bag liner is pulled through the orifice 8 after which it is cut off to provide drainage for the trash bag.

Figure 2:
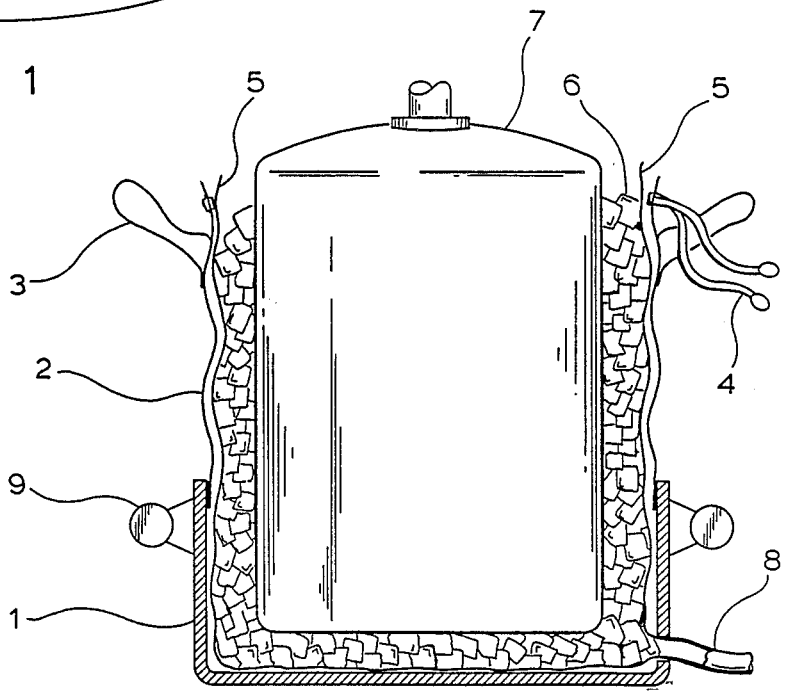
FIG. 2 is a side sectional view of the keg cooler tub.

The sectional side view of FIG. 2 shows the keg 7 encased in the trash bag liner 5 and the space between the trash bag 5 and the keg filled with ice cubes 6. Fabric handles 3 on the canvas sleeve and rigid handles 9 on the base are shown with the draw string 4. The orifice 8 through which the trash bag is drained is shown on the bottom/side of the base 8.

We claim:

1. A transportable beverage keg container providing space for coolant material between a plastic liner and the enclosed keg wherein the improvement comprises:

(a), a sturdy circular tub-like base having a canvas sleeve extending upwards from the top circular edge of the base;

(b), the top edge of the sleeve having draw string means for securing the sleeve to the enclosed keg;

(c), a conventional plastic trash bag used as a water proof liner for the sleeve enclosure;

(d), radial spacing provided between the keg trash bag liner interface for introducing ice or coolant material;

(e), an orifice on the bottom outside perimeter of the base unit for draining the liner enclosure;

(f), rigid handles or the outer surface each side of the base; and, (g), fabric handles the outer surface each side of the canvas sleeve.

* * * * *